United States Patent [19]

Ware

[11] Patent Number: 4,469,325

[45] Date of Patent: Sep. 4, 1984

[54] EXERCISE MACHINE

[75] Inventor: Maximilian Ware, Rapidan, Va.

[73] Assignee: Maxcraft, Winona, Md.

[21] Appl. No.: 354,660

[22] Filed: Mar. 4, 1982

[51] Int. Cl.[3] ..... A63B 69/06; G01L 5/02

[52] U.S. Cl. ..... 272/72; 73/379; 188/67; 272/131; 272/DIG. 5; 338/22 R

[58] Field of Search ..... 272/72, 67, 68, 116, 272/125, 131, DIG. 4, 133, 130, DIG. 5; 73/379; 188/67; 338/22 R; 374/141

[56] References Cited

U.S. PATENT DOCUMENTS

| | | | |
|---|---|---|---|
| 161,629 | 4/1875 | Moore | 272/72 |
| 199,432 | 1/1878 | Goldie | 272/72 |
| 203,973 | 5/1878 | Willcox | 272/72 |
| 1,015,071 | 1/1912 | Reach . | |
| 1,552,073 | 9/1925 | Mansfeldt | 272/68 X |
| 1,707,791 | 4/1929 | Anderson | 272/131 X |
| 2,183,345 | 12/1939 | Brandon . | |
| 2,455,439 | 12/1948 | Page | 188/67 |
| 2,475,667 | 7/1949 | Jackson . | |
| 2,621,043 | 12/1952 | Olmstead . | |
| 2,901,907 | 9/1959 | Ashcroft | 374/141 |
| 3,009,747 | 11/1961 | Pitzer | 188/67 UX |
| 3,380,737 | 4/1968 | Elia et al. . | |
| 3,385,111 | 5/1968 | McGinn | 272/72 X |
| 3,473,843 | 10/1969 | Hart . | |
| 3,606,317 | 10/1969 | Frailey . | |
| 3,637,205 | 1/1972 | Bankston | 272/68 |
| 3,785,644 | 1/1974 | Bradley et al. . | |
| 3,811,672 | 5/1974 | Simmons | 272/67 X |
| 3,912,264 | 10/1975 | Busse et al. . | |
| 3,971,255 | 7/1976 | Varney et al. | 272/131 X |
| 4,093,210 | 6/1978 | Terpening . | |
| 4,284,272 | 8/1981 | Evans et al. . | |
| 4,382,246 | 5/1983 | Hansson et al. | 338/22 R X |
| 4,385,760 | 5/1983 | Mattox et al. | 272/131 |

FOREIGN PATENT DOCUMENTS

| | | | |
|---|---|---|---|
| 150850 | 9/1981 | German Democratic Rep. | 272/72 |
| 2057276 | 4/1981 | United Kingdom | 272/125 |
| 825121 | 4/1981 | U.S.S.R. | 272/72 |

*Primary Examiner*—Robert A. Hafer
*Assistant Examiner*—Arnold W. Kramer
*Attorney, Agent, or Firm*—Oblon, Fisher, Spivak, McClelland & Maier

[57] ABSTRACT

An exercise machine for simulating the stroke of a canoe paddle is disclosed. A tube is pivotably mounted on the longitudinal axis of a frame. A paddle-like shaft is pivotally connected to a frictional resistance element sidably mounted on the tube. The frictional resistance element provides greater resistance to movement in one directional sense than to movement in the other directional sense to that the stroke and return stroke of a canoe paddle can be simulated. The frictional resistance element is formed of an outer member having a conical inner surface and an inner member having a conical outer surface, the inner member being fabricated into two halves on either side of a longitudinal plane. The tube passes through a longitudinal bore of the inner member, the bore being lined with frictional material. Forces acting to move the frictional resistance element in a first direction cause the outer member to compress the halves of the inner member as a function of the cone angle. The compression of the halves of the inner member increases the frictional force between the tube and the inner member, thus resisting further movement. The compression is eliminated for movements in the opposite directional sense.

11 Claims, 5 Drawing Figures

EXERCISE MACHINE

BACKGROUND OF THE INVENTION

1. Field of the Invention:

The present invention relates to an improved exercise machine having components with increased resistance to movement depending upon the direction of movement. More particularly, the present invention relates to a device for simulating the paddling of a canoe and for determining the quantity and quality of work performed during an exercise session. Such an exercise device can be part of an overall program of physical conditioning in which strength and stamina may be measured over time or in comparison to other individuals.

2. Description of the Prior Art:

Exercise machines have been known in the prior art. These devices provide resistance to movement and increased the strength and stamina of the user. Rowing or paddling a canoe is an excellent form of exercise for strengthening the upper body, particularly the arms, improving cardio-vascular functions and for training for competitive events. However, it is not always convenient for an individual to paddle a canoe or to row a boat and thus attempts have been made to design an exercise machine which will simulate the paddling of a canoe or the rowing of a boat. The paddling of the canoe and the rowing of the boat have the common feature that the resistance to movement varies depending upon the direction of movement. That is, in such rowing or paddling, resistance is great during the paddle stroke but is minimal during the return stroke. Thus, exercise machines which simulate the paddling or rowing motions must provide such differential resistance.

For example, U.S. Pat. No. 228,277 to Saunders discloses an exercising machine that simulates the rowing of a boat. This patent provides a differential resistance by use of an air pump. The air pump has a working stroke that requires effort and a return stroke that is practically free of effort. However, such an air pump is costly and easily broken and is considered to be unsatisfactory.

SUMMARY OF THE INVENTION

It is an object of the present invention to provide an exercise machine which offers differential resistance to motion depending upon the direction of movement.

It is another object of the present invention to provide an exercise machine which simulates the paddling of a canoe.

It is another object of the present invention to provide an exercise machine which provides data for permitting a user to analyze the work performed during an exercise session.

It is a final object of the present invention to provide an exercise machine which converts physical exercise into heat and measures the produced heat so that the quantity and quality of work performed can be analyzed.

The present invention achieves the above objects in a structure which includes a support frame upon which the user can sit during an exercising session. A pair of support arms are pivoted to either end of the frame along the longitudinal axis of the frame. The other ends of the support arms carry an elongated tube so that the tube can rotate to either the left or right side of the frame by pivoting about the longitudinal axis thereof. A frictional resistance element of the machine is slidably mounted on the tube and is constructed so that it provides a low resistance to movement in one directional sense along the tube but a much higher resistance to movement in the opposite directional sense. A paddle-like shaft is pivotally fixed to the frictional resistance element. Thus, a user sitting upon the frame can simulate the stroking of a canoe paddle by grasping the paddle-like shaft and applying the forces to the frictional resistance element through the shaft, thereby reciprocating the frictional resistance element along the tube. Several strokes of the paddle-like device can be performed on, for example, the left side of the user, after which time the tube and frictional resistance element are pivoted to the right side of the user for further strokes, thus simulating the motions when paddling the canoe.

The frictional resistance element consists of a truncated conical inner member housed within a coaxial outer member. The inner member is bifurcated on either side of a plane extending along the axis of the inner member so as to form two inner member halves. The inner member includes a longitudinal bore within which the tube is positioned. The longitudinal bore of the inner member is lined with frictional material, such as wool pads, so that the bifurcated halves of the inner member can slide along the length of the tube with frictional contact provided by the frictional material.

The outer member is hollow. It has a conical inner surface whose slope is identical to that of the outer surface of the inner member so that the outer member can snugly fit around the inner member with surface contact along the entire length. An axial force on the outer member in the direction of the base thereof will thus tend to move both the outer and the inner members in that direction. However, due to the conical slope of the inner surface of the outer member and the outer surface of the inner member, a portion of the axial force will be converted into a radial component compressing the bifurcated halves of the inner member, the magnitude of this radial component being a function of the cone angles. Thus, if a user "strokes" with the paddle, e.g. moves the paddle toward himself in the direction of the base of the cones, the bifurcated halves of the inner member will compress against the tube, increasing the frictional force between the frictional material and the tube so that the resistance to motion will be increased.

Upon a "return stroke", i.e. the movement of the paddle forward away from the user and in the direction of the apex of the cones, the outer member will tend to move away from the inner member so that the compressive component upon the halves of the inner member will be eliminated. Accordingly, the frictional resistance between the frictional material and the tube will dramatically decrease and there will be a noticeably lower resistance to movement of the frictional resistance element during the return stroke.

The return stroke also has the effect of causing the inner and outer members to tend to separate in the axial direction. Thus, the present invention provides means for maintaining the inner member housed within the outer member. This is provided by a half-washer fixed to the apex and of one of the inner member halves and extending radially outward so that it can engage the apex end of the outer member. Movement of the outer member in the direction of the apex of the cones during a return stroke will therefore cause the apex end of the outer member to engage the half-washer and thus carry one of the halves of the inner member in the same direction. A washer fixed to the other end of the inner member half engages the base end of the other inner member half and moves this other half in the apex direction as well.

Accordingly, exercise with the machine of the present invention consists of sitting upon the frame seat with the support arms extending to either the left or the right side, performing several strokes and return strokes and switching the support arms to the opposite side at regular intervals, thus simulating the paddling of the canoe. During the stroking of the paddle, physical work is performed by movement of the frictional resistance element in opposition to the frictional force between the frictional resistance element and the tube. This movement in opposition to frictional resistance converts the energy of the user into heat which raises the temperature of the tube. The tube is formed of a material having good heat transfer properties and the temperature of the tube will thus rise in a fairly uniform manner. According to the present invention, a temperature sensor, such as a thermistor, is positioned within the tube for measuring the temperature of the tube. The thermistor is electrically connected to a digital thermometer mounted on the frame and having a readout visible to the user. The user can measure the maximum temperatures which the tube reaches during exercise, thus giving an indication of the strength of the strokes. The user can also plot the temperature over time, and the rate of decline of temperature over time, thus determining his stamina. Plots of temperature over time can be compared during the extent of the exercise program or amongst different individuals, for making comparisons. A strip chart recorder or microprocessor could be employed to plot the time versus temperature during an exercise session.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figure 1:
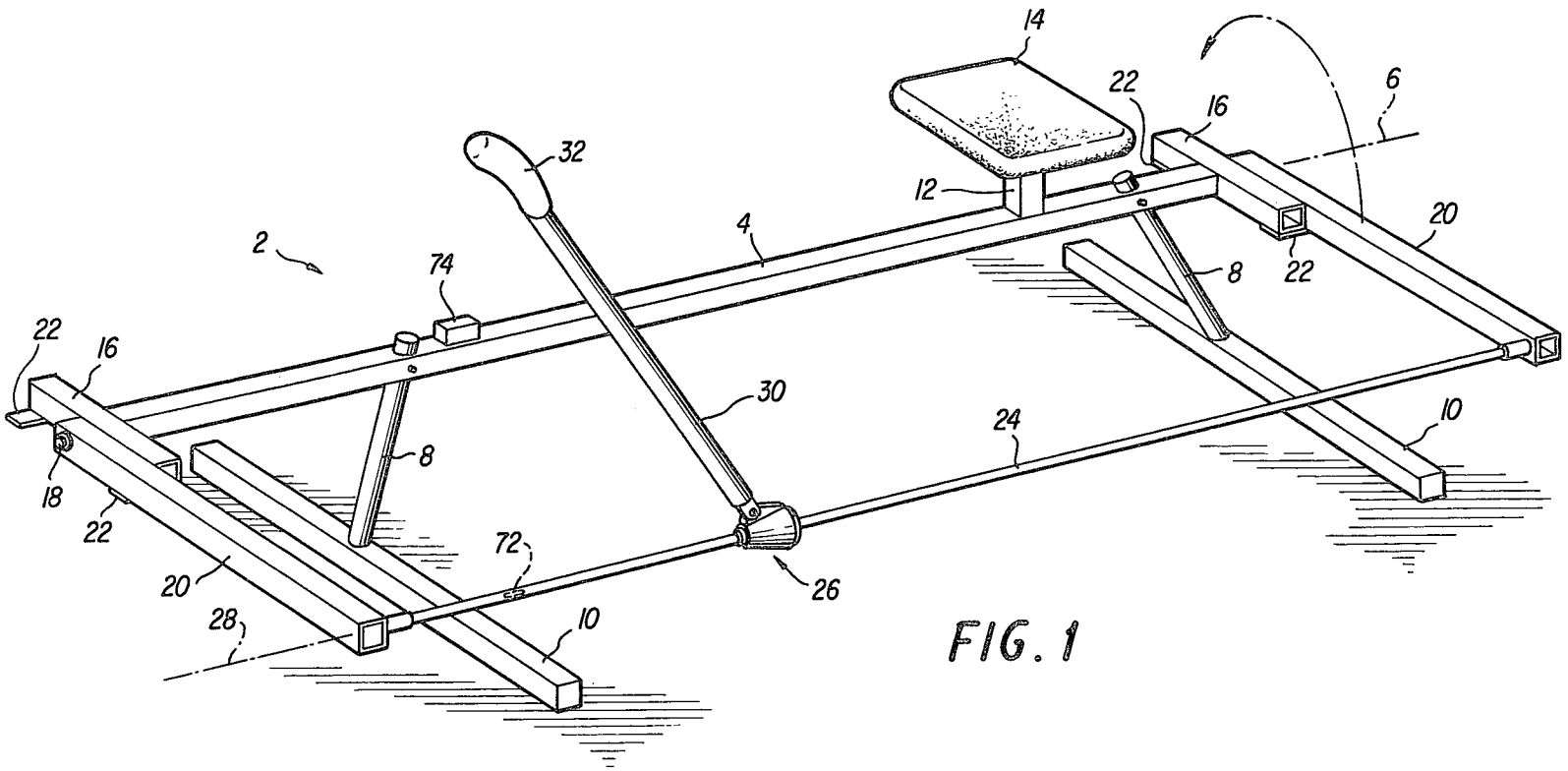
FIG. 1 is an orthogonal view of the apparatus of the present invention.

The present invention will now be described with reference to the accompanying drawings in which like reference numerals will identify the same or similar parts throughout the various views.

As best seen in FIG. 1, the exercise machine of the present invention is mounted upon a frame 2 which is preferably constructed of lightweight steel or aluminum tubing having a circular or rectangular cross-section. The main frame member 4 extends from the front to the back of the machine along the longitudinal axis 6. The main frame member 4 is supported by a pair of legs 8 and leg bases 10 mounted to the main frame adjacent either end thereof. The frame members can be secured to one another by any desired method, such as by welding or bolting.

A seat post 12 is mounted to the top of the main frame member near the rear end (right end in FIG. 1) thereof. A seat 14 is mounted on the seat post. The seating position can be fixed as is shown in FIG. 1, but could also be adjustable in height or along the length of the main frame member.

At either end of the main frame member is mounted a support brace 16 which extends transverse to the longitudinal axis 6 of the main frame member. Support rods 20 are rotatably held by each of the support braces for rotation about axis 6. The support rods 20 may be rotatably secured to the support braces by bolt 18, or by any other desired means. Stops such as plate extensions 22 are secured to the underside of the ends of each support brace 16. These stops limit the angle rotation of the support rods to 180 degrees. Thus, the support rods can pivot from the positions shown in FIG. 1 wherein they extend horizontally to the left of a user sitting in the seat 14 and facing the front of the exercise machine, to a position in which they extend horizontally to the right of the user. Accordingly, paddling can be simulated on either the right or left side of the user by pivoting the supports rods 20 about the axis 6.

Secured to the distal ends of each of the support rods, and extending therebetween, is a thin-walled rigid structural tube 24 formed of a material having good heat transfer characteristics, such as steel or aluminum. The frictional resistance element, identified generally as 26, is slidably mounted upon the tube 24 for sliding movement along the axis 28 of the tube 24. A paddle-like shaft 30 having a handle 32 is pivotally mounted to a lug 34 extending from the frictional resistance element. The shaft 30 is rotatably mounted on the lug 34 about an axis transverse to the axis 28 of the tube, by means of a screw 36 passing through a hole 38 of the lug.

Figure 2:
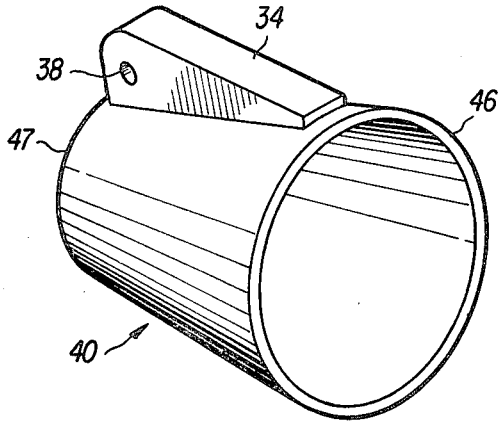
FIG. 2 is an orthogonal view of the outer member of the frictional resistance element.
Figure 3A:
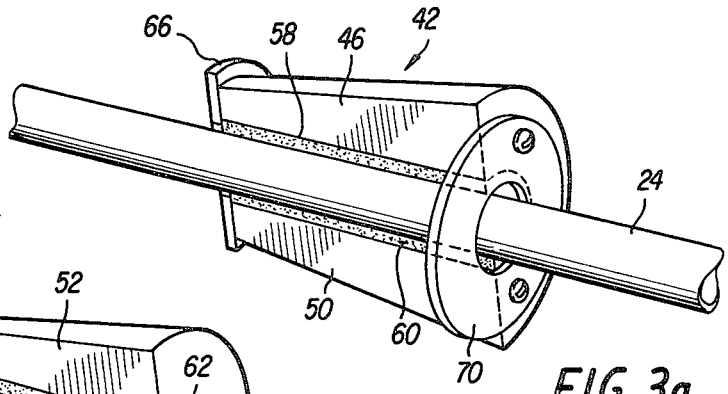
FIG. 3*a* is an orthogonal view of one of the inner member halves, mounted upon the tube.
Figure 3B:
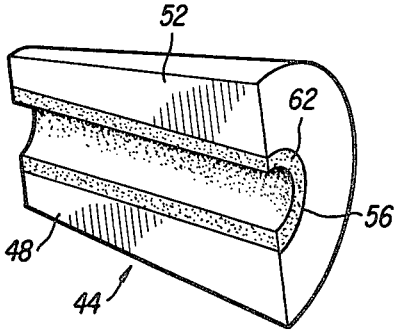
FIG. 3*b* is an orthogonal view of the other inner member half shown rotated 180 degrees about its longitudinal axis from its operating position.
Figure 4:
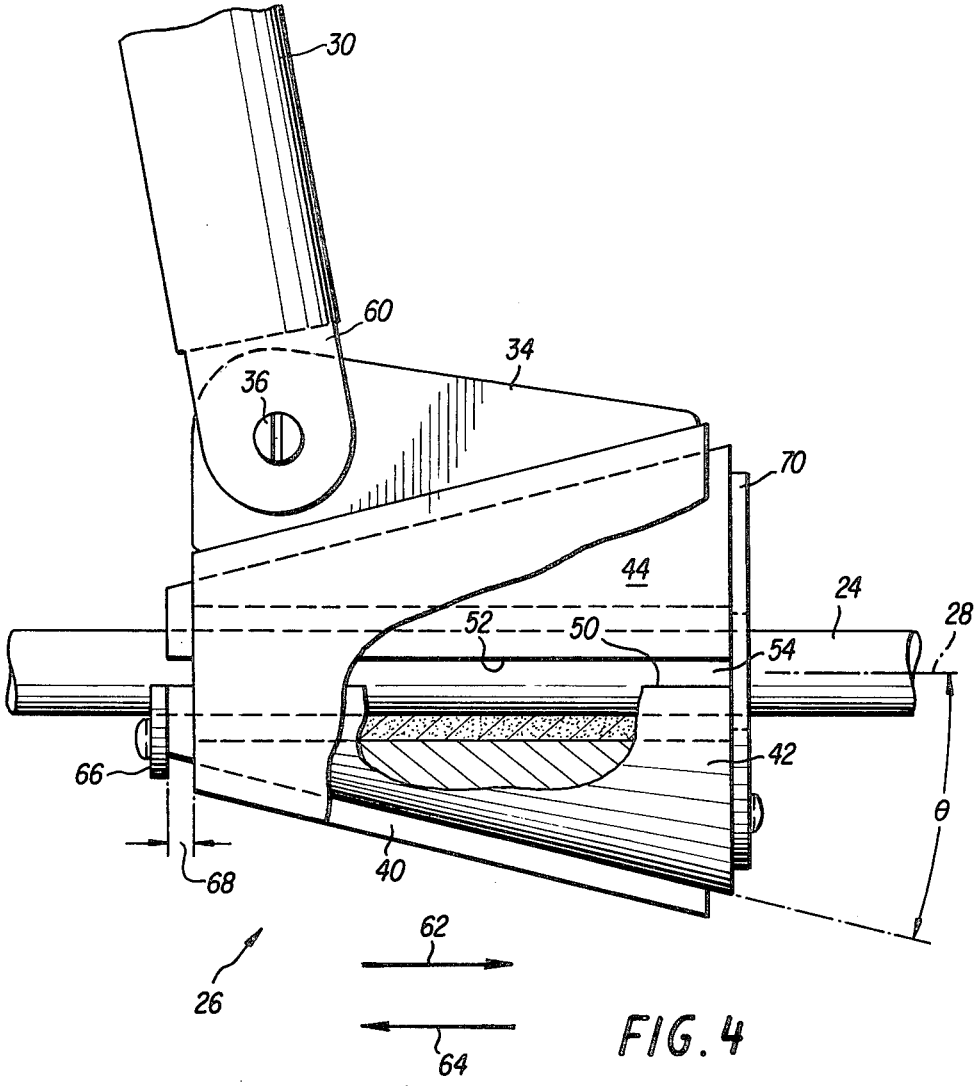
FIG. 4 is an elevational view, partially in section, of the frictional resistance element mounted upon the tube.

The frictional resistance element is best seen in FIGS. 2 through 4. It consists of an outer member 40 to which the lug 34 is fixed and an inner member coaxially housed within the outer member. As best seen in FIG. 3*a* and 3*b*, the inner member is bifurcated on either side of a plane extending longitudinally of the axis of the inner member, thus forming a first inner member half 42 and an identical second inner member half 44.

As best seen in FIGS. 2 and 4, the outer member 40 is in the form of a hollow truncated cone having a base end 46 and an apex end 47. Although in the preferred embodiment both the inner and outer surfaces of the outer member are conical with the same slope $\theta$, only the inner surface need be conical; the outer surface of the outer member could be cylindrical or of some other form.

The halves 42 and 44 of the inner member are normally positioned within the outer member 40 with the planar faces 46 and 48 facing one another, and the planer faces 50 and 52 facing one another so that the inner member halves together form a truncated conical outer surface within the interior of the outer member. The conical slope $\theta$ of the outer member inner surface and the inner member outer surface are identical so that the inner member can seat itself with surface contact within the outer member, as best seen in FIG. 4. When so seated, the halves 42 and 44 remain separated by a gap 54.

The inner member halves 42 and 44 each define the halves 56 and 58 of a cylindrical bore extending through the entire length of the inner member coaxial with the longitudinal axis thereof. The surfaces of the bore halves 56 and 58 are lined with a wool pads 60 and 62, such as frictional material affixed to the walls of the bore with glue.

The inner member halves are mounted on the tube 24, as shown in FIG. 4 so that the tube 24 fits within the longitudinal bore and in contact with the frictional material 60 and 62. The inner member halves 42 and 44, together forming an inner conical member, remain separated by the gap 54 which is maintained by the contact of the frictional material with the tube 24.

The inner and outer members 40, 42 and 44 are preferably formed of polyurethane elastomers but could instead be formed of any hard engineering thermoplastics. As best seen in FIG. 4, the end of the rod 30 is bifurcated into two arms, only one of which 60 is shown, which fit on either side of the lug 34 adjacent to the hole 38 for passage of the screw 36 so that the shaft 30 is pivotably fixed to the lug 34.

The frictional resistance element is positioned upon the tube 24 with the base end 46 facing towards the back (to the right in FIG. 1) of the frame. A force acting in the direction 62 (FIG. 4), such as might be imparted by a stroking movement applied to shaft 30, will tend to cause the outer member 40 to move in the direction 62. This movement of the outer member 40 transmits a force having radial and axial components to the inner member, the proportions of the radial and axial components being a function of the angle $\theta$. Thus, the movement of the outer member 40 in the direction 62 tends to radially compress the halves 42 and 44, particularly at the frictional material 60 and 62, due to the radial component of the force transmitted from the outer member 40. The increased compressive forces between the frictional material 60 and 62 and the surface of the tube 24 increases the frictional resistance of the frictional resistance element 26 to movement along the tube. As the gap 54 decreases, the inner member axially moves slightly with respect to the outer member 40 and fits more snugly within the outer member so that the radial pressure on the inner member is maintained. Thus, movement of the frictional resistance member in the direction 62 will be opposed by a strong frictional resistance force resulting from the frictional material compressed against the tube 24.

The magnitude of the resultant resistance force to movement in the direction 62 is a function of the coefficient of friction between the tube 24 and the frictional material, as well as the angle $\theta$. In particular, if the angle $\theta$ is greater than the angle of the coefficient of friction, it will be impossible to move the frictional resistance element in the direction 62. The angle $\theta$ should therefore be selected so as to provide the desired degree of resistance to movement. It has been found that an angle of 14 degrees provides good resistance when using a steel tube 24 with wool friction pads.

As discussed above, movement of the frictional resistance element in the direction 62 increases the frictional force between the frictional material and the tube 24. Thus, moving the shaft 30 in the direction 62 simulates the stroke of a canoe paddle against the resistance of water. The return stroke of the paddle is simulated by moving the paddle in the direction 64 (to the left in FIG. 1) and must offer reduced resistance since a canoe paddle is normally out of the water during the return stroke. Referring to FIG. 4, a force in the direction 64 imparted on the outer member 40 by the shaft 30 causes the inner conical surface of the outer member to separate from the conical halves of the inner member, thus eliminating the increased radial compressive forces between the tube 24 and the frictional material 60 and 62. Therefore, resistance to the movement of the frictional resisting element 26 is greatly reduced in the direction 64, effectively simulating the return stroke of a canoe paddle.

However, movement of the outer member 40 in the direction 64 also tends to axially separate the inner and outer members and thus some means is necessary for maintaining the inner member housed within the outer member 40 as the outer member moves in the direction 64. According to the present invention, a half-washer 66 is fixed, as by screws, to the apex end of one of the inner member halves 42. The half-washer 66 extends radially outward from the outer surface of the inner member half 42 so that when the outer member 40 moves in the direction 64 by a distance 68, the apex end 47 of the outer member will make contact with the washer 66 and carry the inner member half 42 in the direction 64. The distance 68 is selected such that the resulting relative axial movement between the outer member and the inner member permits the inner member halves 42 and 44 to radially separate sufficiently for the resistance to movement in the direction 64 to be practically eliminated. A washer 70 fixed to the base end of the inner member half 42 makes contact with the base end of the inner member half 44 and moves the inner member half 44 in the direction 64 together with the inner member half 42.

The frictional opposition of the movement of the frictional resistance element in the direction 62 produces heat which raises the temperature of the tube 24, the produced heat being proportional to the work performed by the user. Because the tube 24 is formed of steel or aluminum, which have good heat transfer properties, the temperature of the thermistor 72, which is located within the tube 24 preferably at a point near the front end of the tube is raised. The increased temperature sensed by the thermistor 72 is registered by the digital thermometer 74 to which the thermistor is electrically connected. Thus, by noting the temperature of the tube 24, one can assess the power being generated by a user. The stamina of the user can be charted by noting the rate of decline of the temperature over time. Time versus temperature graphs of the user may be plotted, either manually or with the aid of a strip chart or microprocessor for comparing the performance of a user over time or for comparing the performances of several users.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exercise machine comprising:

an elongate frame defining a horizontal axis and a vertical plane containing said axis;

support means having one end rotatably connected adjacent each said axial end of said frame for rotation about said axis, and having a second end;

substantially linear guide means connected to said support means adjacent said second ends and extending between said support means;

connecting means mounted on said guide means for movement in two directional senses along said guide means, said connecting means including means for imparting a first resistant force to movement of said connecting means in a first said directional sense and for imparting a second resistant force, smaller than said first resistant force, to movement of said connecting means in a second said directional sense;

a paddle shaft pivotally mounted on said connecting means; and stop means positioned for limiting the angle of rotation of said support means about said axis such that said connecting means can be positioned on either side of said vertical plane.

2. The exercise machine of claim 1 wherein said stop means are fixed to said frame at positions such that the pivoting of said support means is limited to 180°.

3. The machine of claim 1 wherein a seat is mounted on said frame.

4. The exercise machine of claim 1 wherein said connecting means comprise:

an inner member having a first truncated conical outer surface and a cylindrical bore extending through said inner member coaxially with the longitudinal axis of said inner member, said inner member being positioned on said guide means such that said guide means passes through said cylindrical bore, said inner member being divided into first and second inner member sections on either side of a plane encompassing said longitudinal axis, said inner member sections being spaced from one another whereby said first and second inner member sections can move radially towards and away from said guide means;

frictional material fixed to the walls of said cylindrical bore, whereby sliding contact is provided between said guide means and said frictional material;

a hollow outer member having a second truncated, conical inner surface, said inner member being positioned within the hollow of said outer member; and pivot means for rotatably connecting said paddle shaft to said outer member about a second axis transverse to said longitudinal axis, whereby a force acting on said outer member in said first directional sense toward the bases of said first and second conical surfaces causes said outer member to press said inner member sections radially inward, thus increasing the frictional resistance between said frictional material and said guide means whereby a force acting on said outer member in said second directional sense toward the apexes of said first and second conical surfaces causes said outer member to release radial pressure on said inner member sections, thus decreasing the frictional resistance between said guide means and said frictional material.

5. The exercise machine of claim 4 wherein the slopes of said first and second conical surfaces are equal.

6. The exercise machine of claim 4 including first limiting means for limiting axial movement between said inner member sections, and second limiting means for limiting axial movement between said inner and outer members.

7. The exercise machine of claim 6 wherein said first limiting means comprises an annular washer fixed to the base end of a first one of said inner member sections and wherein said second limiting means comprises a half washer fixed to the apex end of said first inner member section, said half washer including an extended portion adapted to contact the apex end of said outer member.

8. The machine of claim 1 wherein said guide means comprise a thin walled tubular member formed of a heat conducting material.

9. The exercise machine of claim 8 including temperature sensing means mounted in said tubular member and temperature readout means mounted on said frame and operatively connected to said temperature sensing means.

10. The exercise machine of claim 9 wherein said temperature sensing means is a thermistor.

11. The exercise machine of claim 10 wherein said temperature readout means is a digital thermometer.

* * * * *